US008089745B2

(12) United States Patent
Wosgien

(10) Patent No.: US 8,089,745 B2
(45) Date of Patent: Jan. 3, 2012

(54) OVERVOLTAGE PROTECTION ELEMENT

(75) Inventor: Joachim Wosgien, Löhne (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 747 days.

(21) Appl. No.: 12/166,862

(22) Filed: Jul. 2, 2008

(65) Prior Publication Data

US 2009/0009921 A1 Jan. 8, 2009

(30) Foreign Application Priority Data

Jul. 2, 2007 (DE) ..... 10 2007 030 653

(51) Int. Cl.
*H01C 7/10* (2006.01)
*H01C 7/108* (2006.01)
*H01C 7/12* (2006.01)

(52) U.S. Cl. ..... 361/127; 361/126; 361/117; 338/20

(58) Field of Classification Search ..... 361/127, 361/126, 117; 338/20
See application file for complete search history.

(56) References Cited

U.S. PATENT DOCUMENTS

| | | | | |
|---|---|---|---|---|
| 4,679,113 | A * | 7/1987 | Book et al. | 361/40 |
| 5,181,000 | A * | 1/1993 | Smith | 333/181 |
| 5,724,221 | A * | 3/1998 | Law | 361/127 |
| 5,982,603 | A * | 11/1999 | Choi | 361/119 |
| 7,684,166 | B2 * | 3/2010 | Donati et al. | 361/118 |
| 2005/0231872 | A1 | 10/2005 | Schimanski et al. | |

FOREIGN PATENT DOCUMENTS

| | | | |
|---|---|---|---|
| DE | 27 18 188 | A1 | 10/1978 |
| DE | 40 42 237 | A1 | 7/1991 |
| DE | 199 21 772 | A1 | 10/2000 |
| DE | 601 12 410 | T2 | 5/2006 |
| EP | 0 716 493 | A1 | 6/1996 |
| GB | 2 345 390 | A | 7/2000 |
| WO | 2005/096464 | A1 | 10/2005 |

* cited by examiner

*Primary Examiner* — Rexford Barnie
*Assistant Examiner* — Zeev V Kitov
(74) *Attorney, Agent, or Firm* — Roberts Mlotkowski Safran & Cole, P.C.; David S. Safran

(57) ABSTRACT

An overvoltage protection element (1) includes a housing (2), two terminals (3, 4) for electrical connection of the overvoltage protection element (1) to current or signal paths to be protected, and an arrester (5, 6), including a varistor, located within the housing (2). In addition to providing a simple structure and installation, the overvoltage protection element (1) is especially well adapted to thermal and dynamic loads, so that no damage to the overvoltage protection element (1) occurs to the outside, wherein the housing (2) includes two metal shells (7, 8) electrically connected to a terminal region (9, 10) of the arrester (5, 6).

14 Claims, 4 Drawing Sheets

OVERVOLTAGE PROTECTION ELEMENT

BACKGROUND OF THE INVENTION

1. Field of Invention

The present invention relates to an overvoltage protection element including a housing and having at least two terminals for electrical connection of the overvoltage protection element to current or signal paths to be protected, and with at least one arrester, including a varistor, located within the housing.

2. Description of Related Art

Electrical circuits and systems normally work without problems using the voltage specified for them, that is, the rated voltage. This does not apply when overvoltages occur. Overvoltages are considered to be all voltages which are above the upper tolerance limit of the rated voltage. They also mainly include transient overvoltages which can occur due to atmospheric discharges, but also due to switching operations or short circuits in power supply grids, and can be galvanically, inductively or capacitively coupled into electrical circuits. In order to protect electrical or electronic circuits, including electronic measurement, control and switching circuits, wherever they are being used, against transient overvoltages, overvoltage protection elements have been developed and have been known for more than 20 years.

Measurement, control and regulation engineering lines form the nerve paths of an industrial system. Their smooth operation therefore presupposes a high level of availability of the transmitted signals. The protective circuits of the corresponding overvoltage protection devices must therefore be matched to different signal and measurement principles. Arresters employed in such overvoltage protection devices can include varistors, suppressor diodes and gas-filled surge diverters or spark gaps and combinations thereof. The individual arresters can be distinguished among others by the level of the discharge capacity or the protective level. While varistors are generally used as a middle protective stage, gas-filled surge diverters and spark-gaps are generally used as coarse protection. Moreover, the individual arresters can be divided into voltage-limiting components (e.g., varistors) on the one hand and voltage-switching elements (e.g., gas-filled surge diverters and spark gaps) on the other. Varistors, as discussed herein, can include arresters, and the like.

As a result of ageing and temporary overvoltages (TOV) in the range of seconds, especially in overvoltage protection elements with a varistor as the arrester, an unwanted increase of the leakage current of the varistor at operating voltages occurs. At present, overvoltage protection elements with a varistor therefore often have a thermal disconnect device by which a varistor which is no longer serviceable is disconnected from the current path to be monitored. In known overvoltage protection elements, the state of the varistor is monitored according to the principle of a temperature switch, so that when the varistor overheats, for example, due to leakage currents, a solder connection provided between the varistor and a separating means is broken, leading to electrical disconnection of the varistor.

Such an overvoltage protection element is described in German patent application DE 695 03 743 T2, which corresponds to European patent application EP 0 716 493 A1. Such overvoltage protection element includes two varistors located parallel to one another, with a thermal disconnect device additionally connected to an optical state display, so that the state of the overvoltage protection element can be read directly on site using the optical state display. As an optical state display, such overvoltage protection element includes a first slide, which is located in the housing, and which is actuated by the separating tongues, which form the separating means, and in doing so interacts with a second slide, which can be moved relative to a viewing window, depending on the position of the first slide.

A similar overvoltage protection device with a thermal disconnect device is also described in German patent application DE 20 2004 006 227 U1, which corresponds to US patent application Publication No. 2005/0231872, wherein a varistor is used as the arrester, according to one embodiment (e.g., shown in FIG. 5). Such an overvoltage protection device consists of a bottom part, which is provided with a terminal, and an overvoltage protection element, which is made as a "protective plug" and which can be simple plugged into the bottom part of the device. In addition, such overvoltage protection device has a changeover contact, acting as the signaler for remote reporting of the state of the overvoltage protection element, and both the changeover contact and also the optical state display can be actuated via a common mechanical actuation system.

However, a disadvantage of such known overvoltage protection devices and overvoltage protection elements is that each opening contact thereof can produce an arc at operating voltages greater than 30 volts and at high current loads. Thus, when the solder connection is broken, an arc can occur between the varistor and the separating means, and which can lead to damage of components located within the overvoltage protection element, or to damage of the overvoltage protection element itself, especially to the plastic housing which surrounds the varistor. Since such overvoltage protection elements or overvoltage protection devices are often located with several adjacent to one another or to other electronic devices in a switchgear cabinet, an arc which occurs within the housing, can cause adjacent overvoltage protection devices or other electronic devices also to be destroyed or damaged.

German patent application DE 601 12 410 T2 discloses an overvoltage protection device that includes a varistor (e.g., shaped as a wafer), which is located in a metal pot-shaped housing and which is braced against the bottom of the housing using a piston-shaped electrode. The housing is closed with a cover, which is either screwed into the pot-shaped housing or is attached by a snap ring or clip, which locks in a groove in the side wall of the housing. In the cover, there is an opening through which the shaft of the electrode is routed out of the housing for electrical connection of the electrode. The second terminal for electrical connection of the overvoltage protection device to the current or signal path to be protected is formed on the housing. For electrical insulation of the electrode relative to the housing, there is provided an insulating ring, which is located within the housing and which likewise, has an opening for the shaft of the electrode.

According to another version, an overvoltage protection device described in German patent application DE 601 12 410 T2 includes two varistor wafers, which are each braced against the middle wall of the cylindrical housing using a piston-shaped electrode. On the housing, a housing electrode clip is formed to connect the housing.

Although making the housing from aluminum does prevent destruction of the housing when an arc occurs on the varistor, the making of electrical contact of the varistor and its arrangement in the housing, and the arrangement and configuration of the electrodes, especially the necessity of routing the electrodes for electrical connection through the housing cover or the end caps electrically insulated from the outside, make such a structure and installation of such an overvoltage protection device relatively complex.

Therefore, an object of the present invention is to develop an overvoltage protection element that it is better matched to thermal and dynamic loads, so that damage of the overvoltage protection element does not occur, advantageously, reducing endangerment of individuals or damage to other adjacent devices, and which can be economically built, and easily, installed.

SUMMARY OF THE INVENTION

The above and other objects are achieved by providing an improved overvoltage protection element, including a housing having two metal shells, with one of the two shells being electrically connected to a terminal region of an arrester. By making the two housing halves or housing shells of metal, advantageously, reliable and durable encapsulation of the arrester, which can include a varistor, located within the housing is achieved. In addition, if, as a result of overloading of the varistor, ignition of an arc or destruction of the varistor occurs, this does not lead to damage to devices adjacent to or outside of the overvoltage protection element, due to the durable metal encapsulation of the arrester. Suppressor diodes, gas-filled surge diverters, and the like, also can be used for the arresters, and being advantageous, especially when using varistors as the arresters. Accordingly, the term varistor is used interchangeably for arrester herein, and without limiting the invention in any respect.

Because at least one of the two shells of the housing is electrically connected to the terminal region of the arrester, the making of electrical contact of the arrester (e.g., the connection of the arrester to one terminal of the overvoltage protection element) can take place simply by way of the shells of the housing, so that a terminal element, which is electrically connected to the arrester, for example, formed as a separate electrode, need not be routed out of the housing. The two housing shells can be made, for example, as milled parts, from punched metals, as deep drawn parts, as castings, and the like, and can be joined to one another in different ways, for example, screwed, welded, soldered, and the like.

According to one embodiment, in the housing of the overvoltage protection element there is provided one arrester, wherein the two shells of the housing are electrically insulated from one another, and with the two housing shells being connected each to one terminal region of the arrester. For example, the electrical connection of the overvoltage protection element can be easily implemented by one terminal at a time being connected in one piece to one of the two shells of the housing.

According to another embodiment, an overvoltage protection element with an arrester is provided, wherein the two shells of the housing are electrically connected to one another and in addition to the arrester there is provided a middle electrode, which is electrically insulated from the two housing shells via an insulator body provided within the housing. The first terminal region of the arrester is then connected in an electrically conductive manner to the first shell of the housing and the second terminal region of the arrester to the middle electrode, which thus is insulated from the second shell of the housing by the insulating body being located between the middle electrode and the second housing shell. The overvoltage protection element can be made integral with at least one of the two housing shells, while the other terminal is connected integrally to the middle electrode.

According to a further embodiment, an overvoltage protection element is provided, and within the housing there are two arresters, including varistors, which are connected electrically in parallel to one another. Between the two arresters there is provided a middle electrode, which is electrically insulated from the shells of the housing, the two shells of the housing being electrically connected to one another. The structure of this overvoltage protection element is such that the first terminal region of the first arrester is connected in an electrically conductive manner to the first shell of the housing and the second terminal region of the first arrester is connected in an electrically conductive manner to the first contact region of the middle electrode. Accordingly, the first terminal region of the second arrester is connected in an electrically conductive manner to the second shell of the housing and the second terminal region of the second arrester is connected in an electrically conductive manner to the second contact region of the middle electrode. The electrical connection both between the arresters and the housing shells and also between the arresters and the middle electrode can be advantageously implemented by a corresponding contact pressure via the housing shells, and thus without a need for weld or solder connections, advantageous, reducing the installation cost, while at the same time increasing the installation reliability.

Advantageously, the electrical connection is implemented between at least one of the two housing shells and at least one terminal region of the arrester via at least one elastic contact element, which is located between the inside surface of the housing shell and the terminal region of the arrester. The electrical connection is ensured by a purely mechanical connection, for example, using the spring force of the contact element. The elastic contact element can be made especially as a flat spring element, for example, as a type of plate spring, leaf spring, and the like.

If the overvoltage protection element has two arresters, including varistors, two elastic contact elements can be provided and which are each located between the first terminal region of the varistor and the opposite inside surface of one shell of the housing. Such overvoltage protection element, thus, includes the two housing shells, the two varistors, the two elastic contact elements, and one middle electrode, which is located between the two varistors. For easier positioning of the elastic contact elements, corresponding depressions or contact points for the contact elements can be formed on the inside surfaces of the two shells of the housing. Compared to devices having varistors which are located in a plastic housing, such a novel overvoltage protection device is greatly simplified, since there need not be any terminal elements on the varistors, and insulation of the varistors by an epoxy or enamel layer need not be employed.

If the two housing shells are electrically connected to one another according to the overvoltage protection element having two varistors, the shells of the housing can be made mirror symmetrically to one another, such that the two shells of the housing each have one plug contact, and the two plug contacts jointly form the first terminal. In further embodiments, the shells of the housing need not be made mirror-symmetrical, and for example, can be made to have different depths, and the like.

The second terminal of the overvoltage protection element is preferably connected in one piece to the middle electrode, with such connection also preferably being made as a plug contact. To ensure electrical insulation between the middle electrode and the two shells of the housing, between the two housing shells there is provided an insulator part by which the plug contact, which is connected to the middle electrode, can be routed out of the interior of the housing.

The above described configuration of the overvoltage protection element with a housing including the two metallic housing shells, advantageously, offers high safety during overload of the varistor or varistors located within the housing. Therefore, such an improved overvoltage protection element can be employed without a need for thermal disconnection, so that in the current or signal path to be protected no additional precautions, for example, in the form of fusible links, and the like, need be employed. In further embodiments, however, a thermal disconnect device can be employed and by which a defective or no longer serviceable varistor can be electrically and safely disconnected from the current path being monitored.

The novel thermal disconnect device can be easily integrated into the housing by at least one opening being formed in the middle electrode in which an insulating element is located, and which expands at a certain temperature, with the expansion of the insulating element pressing the second terminal region of one arrester or both arresters away from the corresponding contact region of the middle electrode. The insulating element, which is located in the middle electrode, due to such expansion, which begins starting at a certain temperature, thus causes electrical separation between the second terminal region of one arrester and the corresponding contact region of the middle electrode. This is especially advantageous in that the thermal disconnect device can be made so as to provide a space saving, for example, by not employing any additional installation space within the housing.

In addition to the above described thermal disconnect device, the overvoltage protection elements according to the exemplary embodiments also can include a mechanical or optical display device, and the like, for displaying the state of the arrester or arresters. Alternatively or in addition thereto, there also can be provided means for remote reporting of the state of the overvoltage protection element, for example, including a corresponding changeover contact, and the like, formed as a signaler. An optical display means can be formed, for example, by a color changing layer or an enamel layer or foil, and the like, applied to the housing, and with a color which changes depending on the temperature of the housing. In such an embodiment, it is sufficient if a corresponding enamel layer or foil is only attached to a certain region of the housing that is visible from the outside.

A mechanical display device can have a movable display element and an elastic actuating element, the actuating element in the normal state of the arrester being connected outside the housing, for example, via a solder connection, and the like. When the solder connection is broken, as a result of heating of the arrester, and thus also of the housing, the actuating element releases the movable display element, so that the display element can move from a first position into a second position. Advantageously, the second position can be used to indicate an error state of the overvoltage protection element.

In addition to a thermal disconnect device, the overvoltage protection element according to another advantageous configuration can also include an overload protection means, which prevents damage to the varistor within the housing when the varistor is short circuited, for example, when an unduly high voltage is present. According to one embodiment, the overload overload protection can be accomplished by the appropriately configuring the inside dimensions of the shells of the housing or by matching the varistor or varistors and the middle electrode in their outside dimensions to one another such that the distance between the edge of the varistor and the inside wall of at least one housing shell and the distance between the edge of the middle electrode and the inside wall of the housing shell is appropriately chosen, such that an arc which occurs at an unduly high voltage on the edge of the arrester on which it is present jumps to the housing shell and via the housing shell to the middle electrode, by which the varistor is short circuited. With such a novel design of the housing, which surrounds the varistors and the middle electrode, which is located between the two varistors, more or less a spark gap arrangement is connected in parallel to the varistors, without additional components being necessary. If there is an overly high voltage on the varistor as a result of the unduly high current amplitude, in general, first a flashover occurs in the edge region of the varistor surface. The current flowing through the arc is discharged via the housing shells to the middle electrode by suitable dimensioning of the inside dimensions of the shells of the housing and the dimensions of the middle electrode.

In a further configuration, overload protection of the varistor is implemented by providing within the housing an elastic metal element whose first end is connected securely to the middle electrode and whose second end in the normal state of the overvoltage protection element is likewise connected to the middle electrode, for example, via a solder connection, and the like. Heating of the varistor leads to heating of the middle electrode, by which the solder connection is broken. The second end of the spring element, which is deflected in the normal state of the overvoltage protection element against its spring force, and which element is held on the varistor by the solder connection, springs away from the middle electrode when the solder connection is broken due to the spring force of the metal element until it adjoins the inside wall of the housing shell and thus makes electrical contact with the housing shell. In this way, in case of an overload, the arrester is short-circuited by the low-impedance connection between the middle electrode and the housing shell.

In particular, there are a host of possibilities for embodying and developing the novel overvoltage protection element of the present invention with reference made both to the claims and also to the following description of the preferred embodiments along with the accompanying drawings.

DETAILED DESCRIPTION OF THE INVENTION

Figure 1:
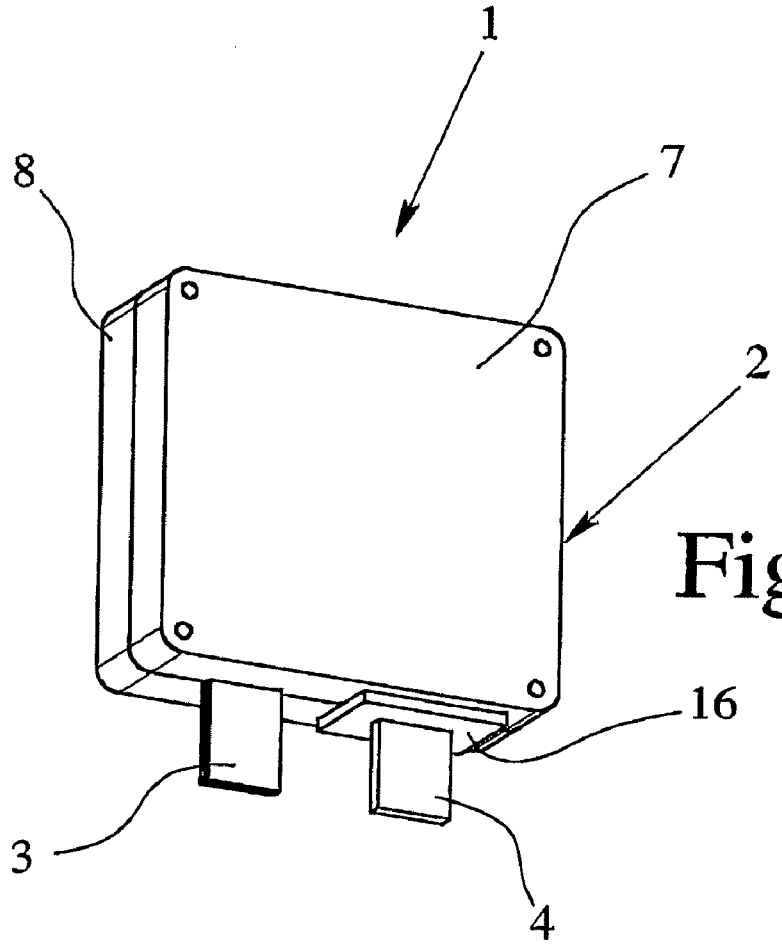
FIG. 1 shows a perspective view of an overvoltage protection element, according to the invention.
Figure 2:
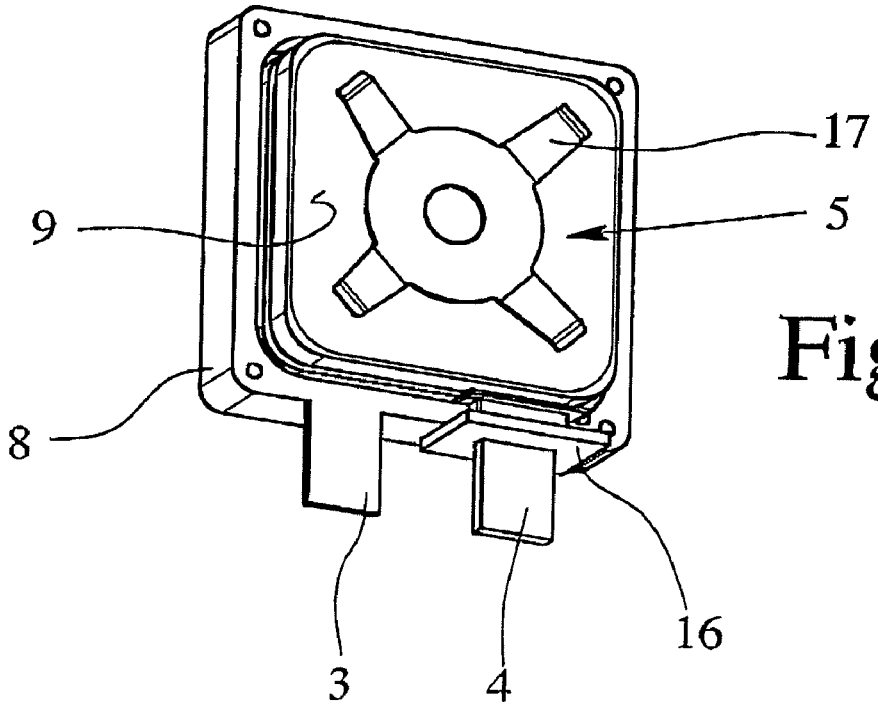
FIG. 2 shows the overvoltage protection element of FIG. 1 with a housing shell thereof removed.
Figure 3:
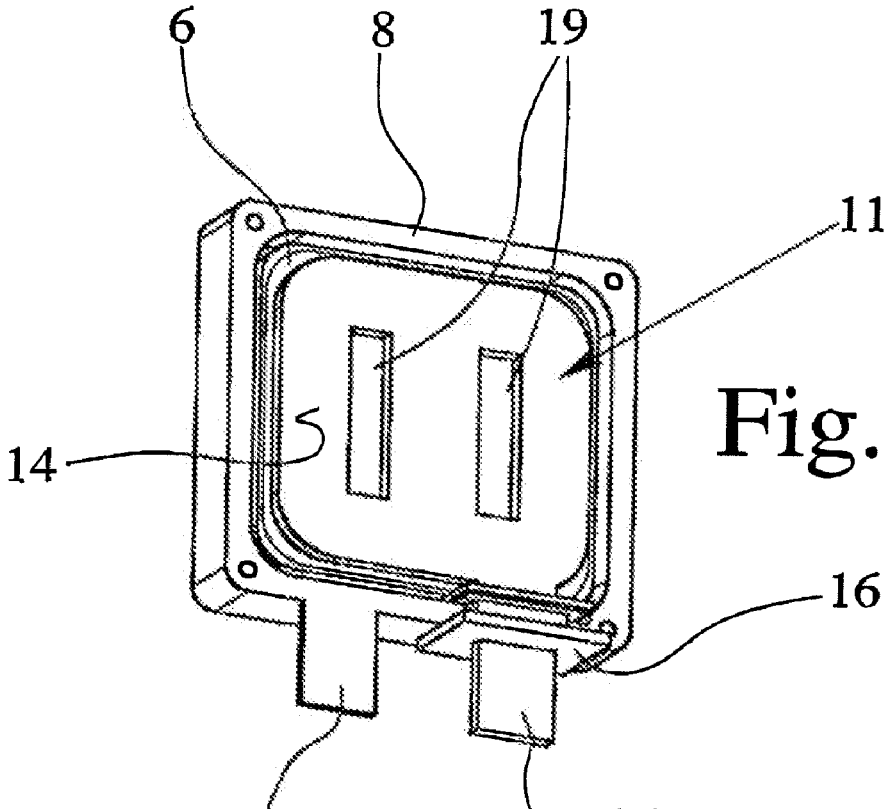
FIG. 3 shows another view of the overvoltage protection element of FIG. 1 when it has not yet been completely installed.

The overvoltage protection element 1 shown in FIGS. 1-6 can be made as a "protective plug" and which can be plugged into the corresponding bottom part of an overvoltage protection device. In addition to the overvoltage protection element 1 being part of a two-part overvoltage protection device, the overvoltage protection element can also be made as a one-piece overvoltage protection device (e.g., it need not have a separate bottom part).

The overvoltage protection element 1 can include a housing 2, two electrical terminals 3, 4 for electrical connection of the overvoltage protection element 1 to the current or signal paths to be protected, and two varistors 5, 6, which are connected electrically in parallel and which are located spatially in succession within the housing 2, and used as arresters. In further embodiments, however, a single varistor 5 can be employed within the housing 2.

The housing 2 has two metal shells 7, 8, each have one plug contact at a time, which projects on one side, with the two plug contacts in the mounted state of the housing 2 jointly forming the first terminal 3 of the overvoltage protection element 1. In this configuration of the terminal 3, the two shells 7, 8 of the housing are thus made mirror symmetrical to one another. In further embodiments, however, it is also possible for there to be a terminal 3 only on one of the two housing shells 7, 8, and with on the other housing shell a corresponding recess being provided for the terminal 3. The projecting plug contacts need not also be employed, for example, if the mounted overvoltage protection element 1 can be plugged into a contact holder, such that the outer sides of the two shells 7, 8 directly make electrically conductive contact.

In the exemplary embodiment with the two varistors 5, 6, which are located between the two housing shells 7, 8, the first terminal region 9 of the first varistor 5 is connected in an electrically conductive manner to the first housing shell 7 and the first terminal region 10 of the second varistor 6 is connected in an electrically conductive manner to the second housing shell 8. Moreover, the two housing shells 7, 8 are interconnected in an electrically conductive manner, wherein specifically in the mounted state they can be interconnected via screws, rivets, and the like. The two housing shells 7, 8 can be made as milled parts, as punched-deep drawn parts, as castings, and the like.

Figure 4:
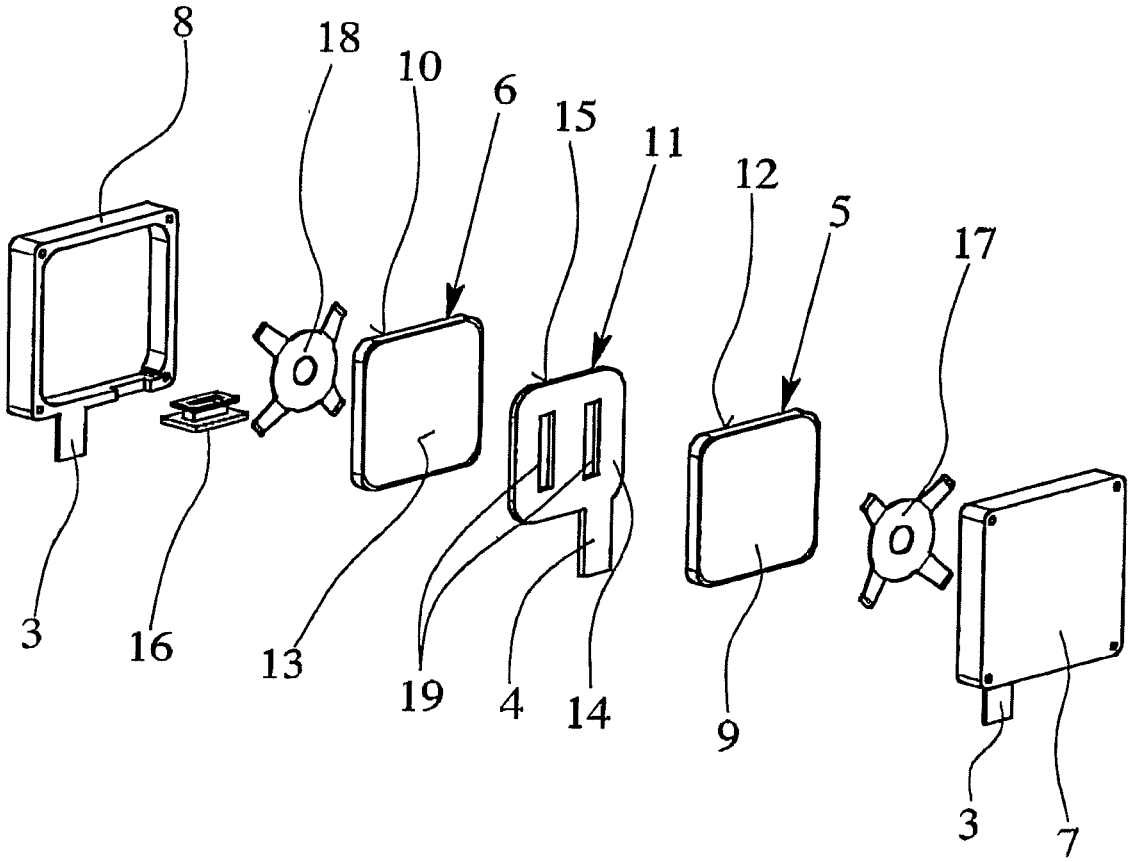
FIG. 4 shows an exploded view of the overvoltage protection device of FIGS. 1 to 3.

As shown in FIG. 4, between the two varistors 5, 6 there is a middle electrode 11, which has a projecting plug contact, which forms the second terminal 4 of the overvoltage protection element 1. In the mounted state of the overvoltage protection element 1, the second terminal regions 12, 13 of the two varistors 5, 6, which each lies on the side of the varistors 5, 6, which is opposite the first terminal region 9, 10, is connected to one side of the middle electrode 11 at a time. In particular, the second terminal region 12 of the first varistor 5 is electrically connected to the first contact region 14 of the middle electrode 11 and the second terminal region 13 of the second varistor 6 is electrically connected to the opposite second contact region 15 of the middle electrode 11.

Since the two housing shells 7, 8 are interconnected in an electrically conductive manner, and to avoid a short circuit of the varistors 5, 6, the middle electrode 11 can be electrically insulated relative to the two housing shells 7, 8. To implement such electrical insulation, between the two housing shells 7, 8 there is provided an insulating part 16 by which the terminal 4, which is connected to the middle electrode 11, is routed out of the interior of the housing 2.

Making of electrical contact both between the housing shells 7, 8 and the varistors 5, 6 and also between the varistors 5, 6 and the middle electrode 11 can take place by contact pressure, which is applied in the mounted state by the housing shells 7, 8. For example, two elastic contact elements 17, 18, each between one housing shell 7, 8 and the first terminal region 9, 10 of the two varistors 5, 6, can be provided. The electrical connection between the two housing shells 7, 8 and the two varistors 5, 6 can thus be implemented by a purely mechanical connection using the spring force of the elastic contact elements 17, 18 and without the need for welding or soldering processes in the installation of the overvoltage protection element 1.

Installation of the overvoltage protection element 1 of FIG. 4 can be easily performed by the two varistors 5, 6, the middle electrode 11 and the two contact springs 17, 18 being inserted into the shell 8 of the housing in the corresponding sequence and then the two housing shells 7, 8 being connected to one another. To complete an overvoltage protection element 1 made as a "protective plug" it is accordingly still only necessary for the installed metal housing 2 to be surrounded by an insulating plastic housing, and the surrounding plastic housing can be made either as a plastic hood or likewise as a two-part housing. As compared to known overvoltage protection elements, an electrically conductive connection between the two varistors 5, 6 and the two housing shells 7, 8 is provided.

The varistors 5, 6 are thin varistor wafers, which need not employ an insulating jacket, such as an epoxy jacket, nor terminal lugs, which are complex to implement in terms of production engineering. The varistors 5, 6 are single, sintered wafers, which on both sides have a conductive coating by which the terminal regions of the varistors 5, 6 are implemented.

If the overvoltage protection element 1 has only one varistor 5, a structure of the overvoltage protection element 1 can be chosen and which differs from the structure shown in FIG. 4, wherein the second varistor 6 is replaced by an insulating body. Moreover, at least one contact spring 18 can be omitted.

Figure 5A:
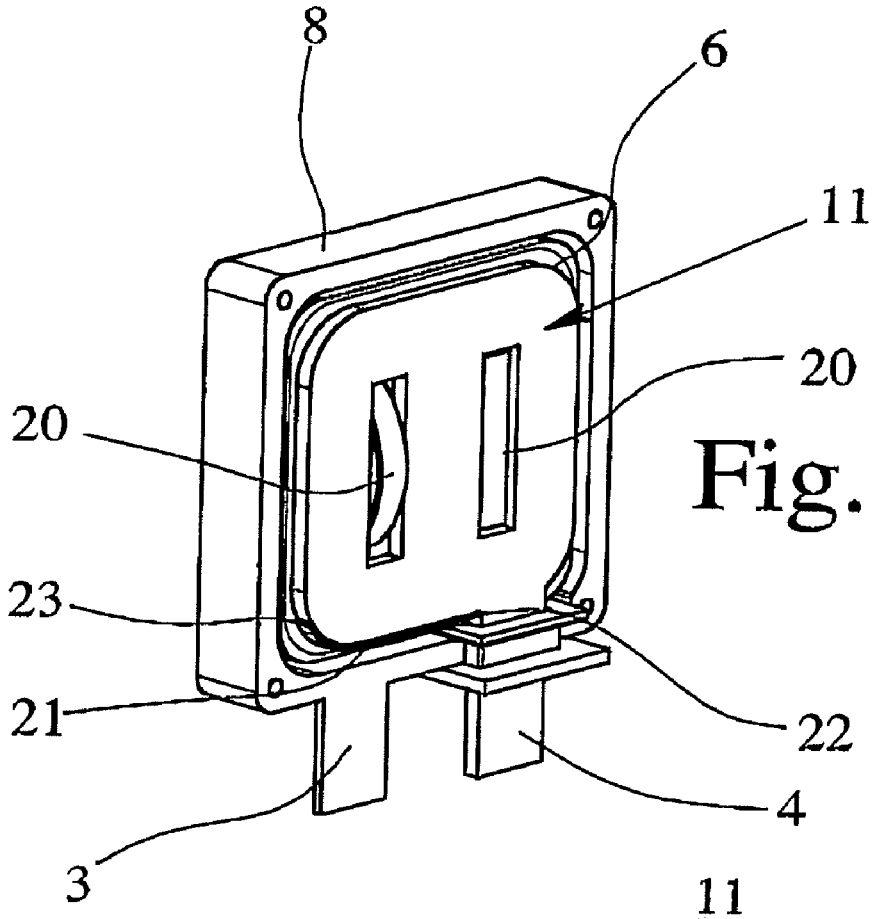
FIGS. 5*a* to 5*b* show another overvoltage protection element with a housing shell removed, and in two different states, according to the invention.
Figure 5B:
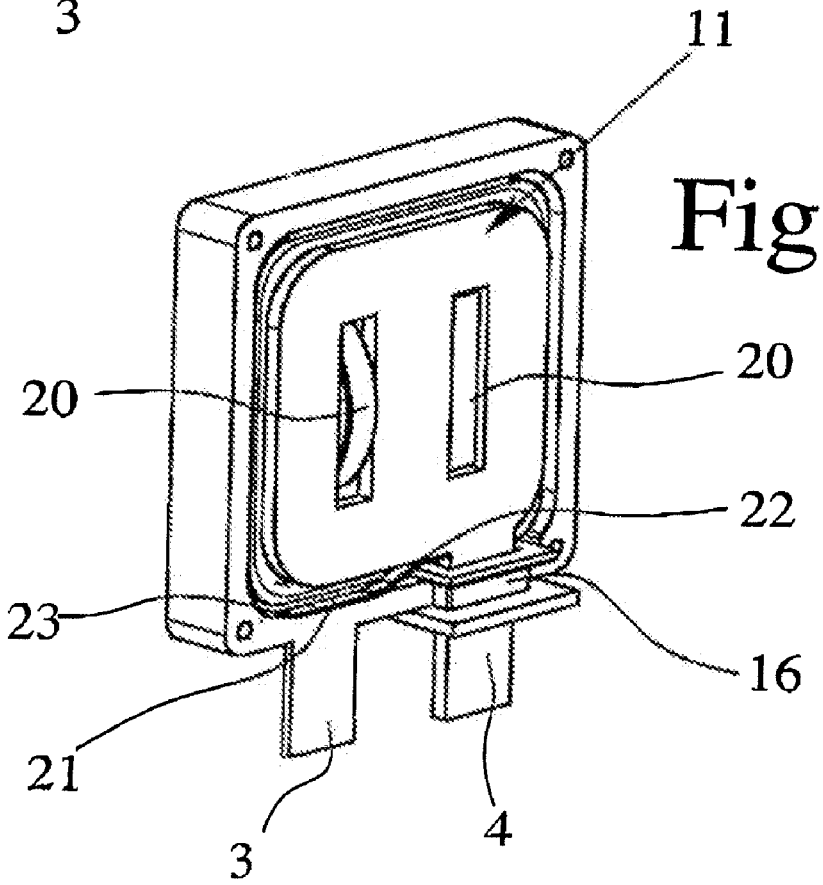

In the overvoltage protection element 1 of FIGS. 5*a* to 5*b*, in addition to safe encapsulation of the varistors 5, 6 by the two metal shells 7, 8 of the housing, there is provided a thermal disconnect device, which is integrated within the housing 2. For example, in the middle electrode 11 there are two openings 19 in which one insulating element 20 at a time is located. The insulating element 20 has the property that it expands at a certain temperature, for example, starting from a temperature of 120° C., by which the two varistors 5, 6, which first adjoin the middle electrode 11, are pressed away from the middle electrode 11. In this way, the electrically conductive connection between the second terminal region 12 of the first arrester 5 and the second terminal region 13 of the second arrester 6 and the corresponding contact regions 14, 15 of the middle electrode 11 is broken.

The insulating element 20 can be a plastic element, for example, which foams up starting at a certain temperature, wherein the increase in volume of the insulating element 20 by foaming forcing the varistors 5, 6 away from the middle electrode 11 against the spring force of the elastic contact elements 17, 18. In addition to an insulating element 20 whose expansion is based on a chemical effect, bimetal strips, memory metal strips, and the like, also can be employed as insulating elements. When using bimetal strips or memory metal strips, care must be taken that the metal strips are insulated, for example, at least in the regions in which they make contact with the varistors, so that an electrical connection between the varistors 5, 6 and middle electrode 11 via the elements 20 does not occur, even though the varistors 5, 6 are forced away from the middle electrode 11 as a result of expansion of the elements 20.

In the overvoltage protection element of FIGS. 5*a* to 5*b*, in addition to the above described thermal disconnect device, an overload protection for the varistors 5, 6 is additionally provided, wherein an elastic spring element 21 in the form of a spring clip is securely connected with its first end 22 and with its second end 23 via a solder site to the middle electrode 11. In the normal state of the overvoltage protection element 1 and the varistors 5, 6, which is shown in FIG. 5*a*, in which the varistors 5, 6 have not yet been overly heated, the second end 23 is held on the middle electrode 11 against the spring force of the deflected metal element 21 by the solder site. If the varistors 5, 6 are heated, for example, as a result of an unallowable leakage current, this leads to heating of the middle electrode 11. Starting at a certain temperature, heating of the middle electrode 11 leads to the solder connection breaking, so that the second end 23 of the metal element 21, as a result of its spring force, detaches from the middle electrode 11 and springs against the inside wall of the housing shell 7, as shown in FIG. 5*b*. In this way, the middle electrode 11 is connected in an electrically conductive manner via the metal element 21 to the housing 2, so that the varistors 5, 6 are short-circuited by this low-impedance connection between the middle electrode 11 and the housing 2. The cross section of the elastic metal element 21 is chosen such that in the case of an overload the short-circuit current, which occurs, can flow via the metal element 21, without the metal element 21 being destroyed.

Figure 6:
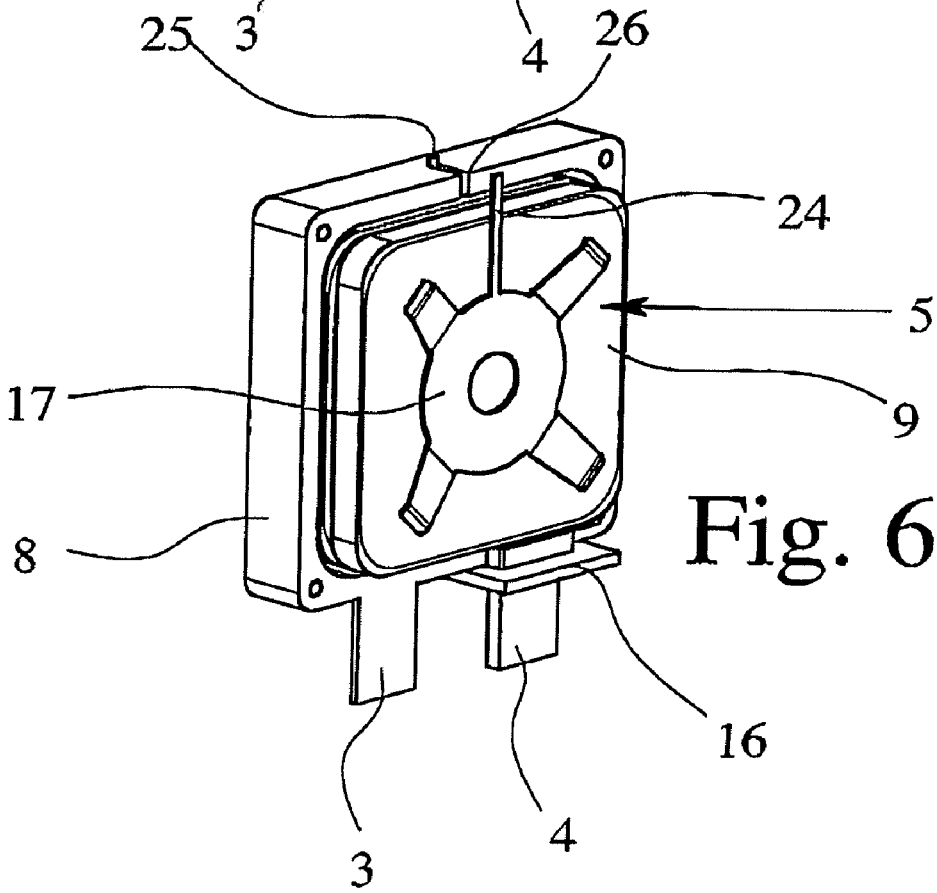
FIG. 6 shows another overvoltage protection element with a housing shell removed, according to the invention.

In addition to a thermal disconnect device and an overload protection, the overvoltage protection element 1 can additionally include a mechanical or optical display means for display of the state of the arresters 5, 6. For example, as shown in FIGS. 4 and 6, two elastic contact elements 17, 18 are provided and each having a respective extension 24, 25, which projects through a slot 26 in the two housing shells 7, 8 from the interior of the housing 2.

If due to the thermal disconnect device of FIG. 5, the two varistors 5, 6 are forced away from the middle electrode 11, this forcing apart of the varistors 5, 6 takes place against the spring force of the two contact elements 17, 18. Thus, when the varistors 5, 6 are forced apart, the contact elements 17, 18 and thus especially also their extensions 24, 25 are forced apart. For a corresponding configuration of the plastic housing, which surrounds the housing 2, this change of the position of the two extensions 24, 25 of the contact elements 17, 18 can be accounted for. In addition to forming a simple viewing window in the surrounding plastic housing, the extensions 24, 25 of the contact elements 17, 18 can also be connected to an additional display element, a position change of the two extensions 24, 25 leading to a change in the position of the display element; and which can be easily detected from the outside.

The features of the invention disclosed in the description above, in the drawings and in the claims are important both individually and also in any combination for implementation of the invention.

What is claimed is:

1. An overvoltage protection element, comprising:

a housing;

at least two terminals for electrical connection of the overvoltage protection element to current or signal paths to be protected; and at least one arrester, including a varistor, located in the housing, wherein the housing includes two metal shells comprising first and second shells, which are connected in an electrically conductive manner to one another, wherein the first metal shell is electrically connected to a terminal region of the arrester, wherein a middle electrode which is electrically insulated from the two housing shells, and an insulating body are provided and located with the housing, wherein the insulating body is located between the middle electrode and the second housing shell, and wherein a first terminal region of the arrester is connected in an electrically conductive manner to the first shell of the housing and a second terminal region of the arrester is connected in an electrically conductive manner to the middle electrode.

2. An overvoltage protection element comprising:

a housing;

at least two terminals for electrical connection of the overvoltage protection element to current or signal paths to be protected; and at least two arresters, including a varistor, which are connected electrically in parallel to one another and located within the housing, wherein the housing includes two metal shells comprising first and second shells which are connected in an electrically conductive manner to one another, wherein a middle electrode, which is electrically insulated from the two housing shells, is provided and located between the two arresters, wherein a first terminal region of the first arrester is connected in an electrically conductive manner to the first shell of the housing and a second terminal region of the first arrester is connected in an electrically conductive manner to a first contact region of the middle electrode, and wherein a first terminal region of the second arrester is connected in an electrically conductive manner to the second housing shell, and a second terminal region of the second arrester is connected in an electrically conductive manner to a second contact region of the middle electrode.

3. The overvoltage protection element of claim 1 or 2, wherein a first terminal of the least two terminals is connected integrally to at least one of the two housing shells and a second terminal of the least two terminals is connected integrally to the middle electrode, the first and second terminals having projecting plug contacts.

4. The overvoltage protection element of claim 2, wherein the two housing shells are made mirror symmetrical to one another and the two housing shells each have one plug contact which jointly form a first terminal of the least two terminals.

5. The overvoltage protection element of claim 1 or 2, wherein between the two housing shells there is provided an insulator part by which a terminal of the least two terminals which is connected to the middle electrode is routed out of the interior of the housing.

6. The overvoltage protection element of claim 1 or 2, wherein an electrical connection is implemented between at least one of the two housing shells and at least one terminal region of the arrester via at least one elastic contact element located between an inside surface of one of the housing shells and the terminal region of the arrester.

7. The overvoltage protection element of claim 2, wherein the two arresters each with their second terminal regions, under contact pressure, respectively adjoin the first and second contact regions of the middle electrode.

8. The overvoltage protection element of claim 1 or 2, wherein in the middle electrode at least one opening is formed in which an insulating element is provided and which expands at a temperature such that the insulating element presses the second terminal region of the arrester away from a contact region of the middle electrode so that the electrically conductive connection between the second terminal region of the arrester and the contact region of the middle electrode is broken.

9. The overvoltage protection element of claim 8, wherein the insulating element is made of one of plastic, an insulating bimetal strip, and an insulated memory metal strip.

10. The overvoltage protection element of claim 1 or 2, wherein an optical or mechanical display device is made or arranged on the housing for display of a state of the arrester.

11. The overvoltage protection element of claim 10, wherein the optical display means is formed by one of a color envelope, an enamel layer or a foil attached visibly at one point on the housing, and which changes a color thereof depending on a temperature of the housing.

12. The overvoltage protection element of claim 10, wherein the mechanical display device has a movable display element and an elastic actuating element, the actuating element in a normal state of the arrester being connected to the housing via a solder connection and when the solder connection is broken as a result of heating of the arrester and thus also of the housing, enables movement of the display element out of a first position into a second position.

13. The overvoltage protection element of claim 1 or 2, wherein on the one hand the housing shells in inside dimensions thereof and the varistor and on the other hand the middle electrode with outside dimensions thereof are matched to one another such that a distance between an edge of the arrester and an inside wall of at least one of the housing shells and a distance between an edge of the middle electrode and the housing shells is chosen such that when an unduly high voltage is present on the arrester, an arc which occurs on the edge of the arrester jumps to the housing shell and via the housing shell to the middle electrode, so that the varistor is short circuited.

14. The overvoltage protection element of claim 1 or 2, wherein within the housing an elastic metal element is arranged such that a first end thereof is connected securely to the middle electrode and a second end thereof in a normal state of the overvoltage protection element is connected to the middle electrode via a solder connection, and the second end of the metal element when the solder connection is broken as a result of heating of the arrester makes contact with an inside wall of the housing shell in an electrically conductive manner so that the housing shell is connected to the middle electrode in an electrically conductive manner.

* * * * *